US006454529B1

(12) United States Patent
Zearbaugh et al.

(10) Patent No.: US 6,454,529 B1
(45) Date of Patent: Sep. 24, 2002

(54) METHODS AND APPARATUS FOR MAINTAINING ROTOR ASSEMBLY TIP CLEARANCES

(75) Inventors: Scott Richard Zearbaugh, Milford; Steven Louis Brickner, Cincinnati; James Warren Hackler, Mason; Lonnie Ray Chadwell, Cincinnati, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/815,757

(22) Filed: Mar. 23, 2001

(51) Int. Cl.[7] ..... F01D 11/24
(52) U.S. Cl. ..... 415/173.2; 415/176
(58) Field of Search ..... 415/173.1, 144, 415/175, 176, 173.2

(56) References Cited

U.S. PATENT DOCUMENTS

| | | | | | |
|---|---|---|---|---|---|
| 4,363,599 | A | | 12/1982 | Cline et al. | |
| 4,893,983 | A | | 1/1990 | McGreehan | |
| 4,893,984 | A | | 1/1990 | Davison et al. | |
| 4,928,240 | A | | 5/1990 | Davison et al. | |
| 5,018,942 | A | | 5/1991 | Ciokajlo et al. | |
| 5,127,793 | A | | 7/1992 | Walker et al. | |
| 5,167,488 | A | * | 12/1992 | Ciokajlo et al. | 415/175 |
| 5,205,115 | A | | 4/1993 | Plemmons et al. | |
| 5,212,940 | A | | 5/1993 | Glover | |
| 5,228,828 | A | | 7/1993 | Damlis et al. | |
| 5,273,396 | A | | 12/1993 | Albrecht et al. | |
| 5,281,085 | A | | 1/1994 | Lenahan et al. | |
| 5,399,066 | A | * | 3/1995 | Ritchie et al. | 415/115 |
| 5,641,267 | A | | 6/1997 | Proctor et al. | |
| 5,685,693 | A | | 11/1997 | Sexton et al. | |
| 5,779,442 | A | | 7/1998 | Sexton et al. | |
| 5,906,473 | A | | 5/1999 | Sexton et al. | |
| 5,913,658 | A | | 6/1999 | Sexton et al. | |
| 5,980,201 | A | * | 11/1999 | Benoist et al. | 415/115 |
| 6,035,929 | A | * | 3/2000 | Friedel et al. | 165/168 |
| 6,079,943 | A | | 6/2000 | Sexton et al. | |
| 6,082,963 | A | | 7/2000 | Sexton et al. | |

* cited by examiner

*Primary Examiner*—Edward K. Look
*Assistant Examiner*—Ninh Nguyen
(74) *Attorney, Agent, or Firm*—Nathan D. Herkamp; Armstrong Teasdale LLP

(57) ABSTRACT

A gas turbine engine including an active clearance control system that facilitates extending a useful life of a rotor assembly in a cost effective and reliable manner is described. The engine includes at least one rotor assembly and an engine casing that extends circumferentially around the rotor assembly, such that a tip clearance is defined between the rotor assembly and the engine casing. The clearance control system includes a plurality of panels that couple to extend circumferentially around the engine. Each clearance control system panel includes a circumferential feed duct that is formed integrally with the panel.

20 Claims, 5 Drawing Sheets

METHODS AND APPARATUS FOR MAINTAINING ROTOR ASSEMBLY TIP CLEARANCES

BACKGROUND OF THE INVENTION

This application relates generally to gas turbine engines and, more particularly, to methods and apparatus for maintaining gas turbine engine rotor assembly tip clearances.

Gas turbine engines typically include an engine casing that extends circumferentially around a compressor and a turbine including a rotor assembly. The rotor assembly includes at least one row of rotating blades that extend radially outward from a blade root to a blade tip. A circumferential tip clearance is defined between the rotating blade tips and the engine casing.

During engine operation, heat generated by the engine may cause thermal expansion of the rotor assemblies, and render the tip clearance non-uniform circumferentially. As a result, inadvertent rubbing between the rotor blade tips and the engine casing may occur. Continued rubbing between the rotor blade tips and engine casing may lead to premature failure of the rotor blade.

To facilitate optimizing engine performance and to minimize inadvertent rubbing between the rotor blade tips and the engine casing, at least some known engines include a clearance control system. The clearance control system supplies cooling air to the engine casing to promote thermal contraction of the engine casing to facilitate mining inadvertent blade tip rubbing. Because the engine casing should be thermally cooled circumferentially, the clearance control systems include a plurality of complex duct work coupled circumferentially around the engine. However, because the engine thermally contracts and expands during operation, the clearance control system also includes a plurality of sliding joints including seals, and support brackets. Over time, continued exposure to vibrational stresses induced during engine operation, may lead to premature failure of the sliding joints and seals, and lead to an eventual failure of the clearance control system.

BRIEF SUMMARY OF THE INVENTION

In an exemplary embodiment, a gas turbine engine includes an active clearance control system that facilitates extending a useful life of a rotor assembly in a cost effective and reliable manner. The engine includes at least one rotor assembly encased within an engine casing extending circumferentially around the rotor assembly, such that a tip clearance is defined between the rotor assembly and the engine casing. The clearance control system includes a plurality of panels that couple together and extend circumferentially around the engine. Each clearance control system panel includes a circumferential feed duct formed integrally with the panel. Adjacent circumferential feed ducts are coupled in flow communication with flexible connection ducts.

During operation, cooling air is supplied to the clearance control system. The cooling air is then distributed circumferentially around the engine casing. As a result of the cooling air being introduced, the engine casing thermally contracts, thus facilitating maintaining the tip clearance and preventing inadvertent blade tip rubbing against the engine casing, and optimizing engine performance. As a result, the clearance control system facilitates extending a useful life of the rotor assembly in a cost effective and reliable manner.

DETAILED DESCRIPTION OF THE INVENTION

Figure 1:
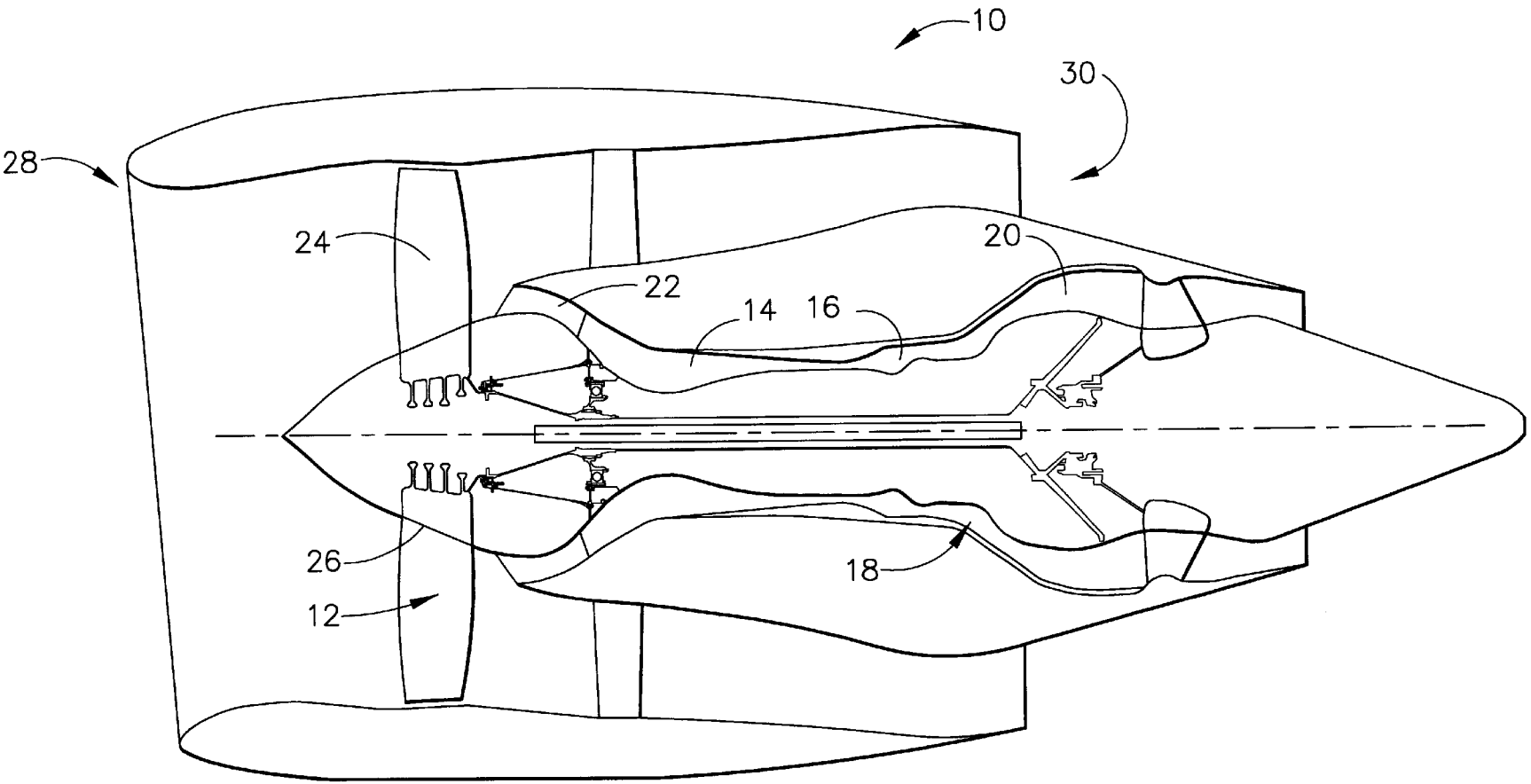
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
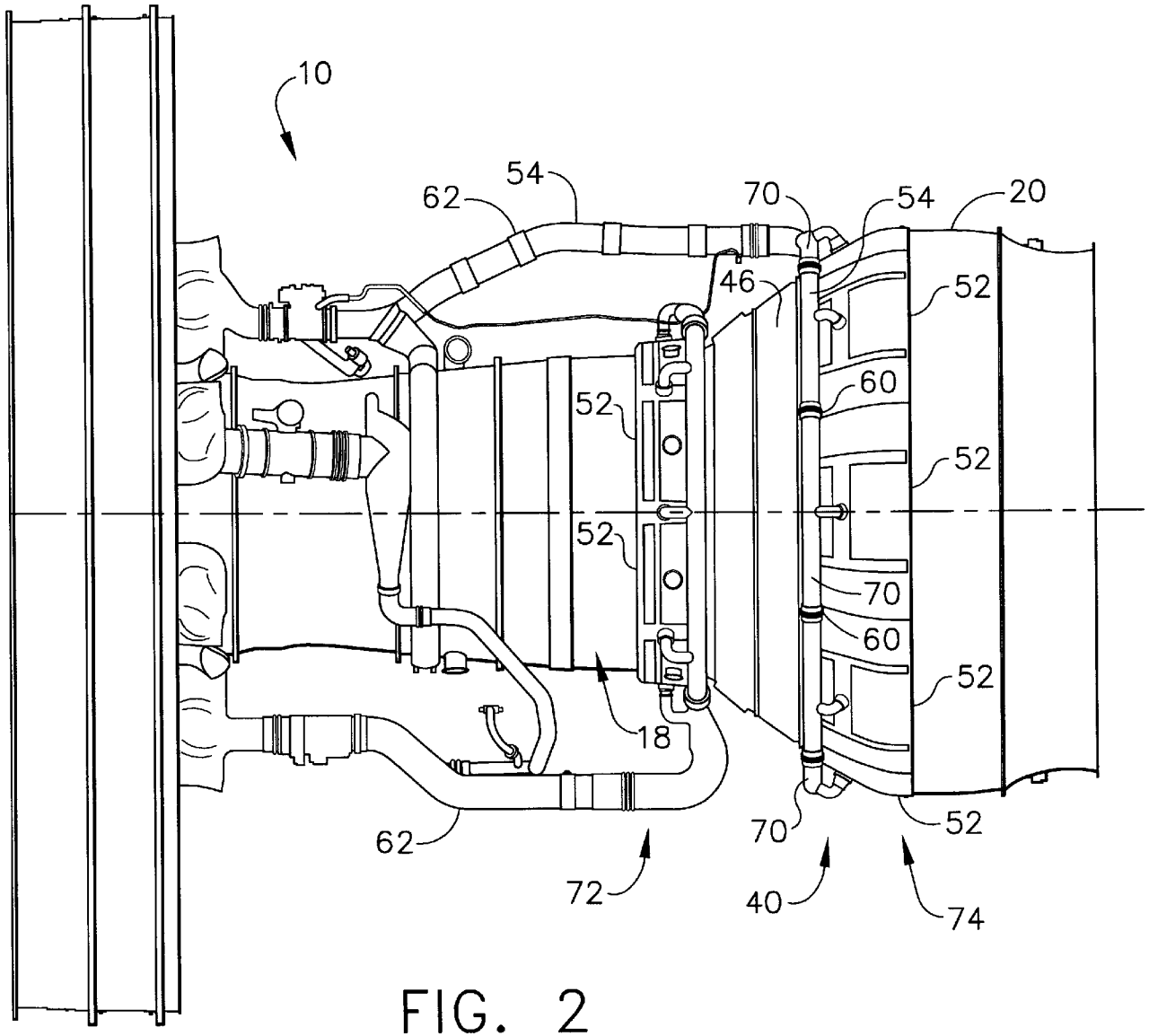
FIG. 2 is side view of a portion of the gas turbine engine shown in FIG. 1 and including a clearance control system.

FIG. 2 is side view of a portion of gas turbine engine 10 shown in FIG. 1 and including a clearance control system 40. In one embodiment, gas turbine engine 10 is a GE90 engine commercially available from General Electric Company, Cincinnati, Ohio. Gas turbine engine 10 includes high pressure turbine 18 and low pressure turbine 20. As is known in the art, each turbine 18 and 20 includes a rotor assembly (not shown) including at least one row of circumferentially-spaced rotor blades (not shown). Each rotor blade extends radially outward from a root (not shown) to a tip (not shown).

An annular engine casing 46 extends circumferentially around gas turbine engine 10 and extends from compressor 14 around combustor 16, and turbines 18 and 20. Casing 46 is disposed radially outward from the rotor blades such that a tip clearance is defined circumferentially between engine casing 46 and the rotor blade tips as the blades rotate.

Clearance control system 40 is coupled to engine casing 46. Control system 40 includes a plurality of panels 52 and a plurality of hollow ducts 54. More specifically, clearance control system 40 is known as an Active Clearance Control, ACC, and distributes cooling air to engine 10 to facilitate controlling the tip clearance between the rotor blade tips and engine casing 46, as described in more detail below.

Ducts 54 include connection ducts 60 and transition ducts 62. Connection ducts 60, described in more detail below, are sometimes known as panel jumpers, and couple adjacent panels 52 circumferentially around engine 10. Transition ducts 62 couple clearance control system 40 in flow communication with a source of pressurized cooling air. In one embodiment, cooling air is bled from a stage of high pressure compressor 14 (shown in FIG. 1), and is delivered to clearance control system 40 through transition ducts 62.

Clearance control system panels 52 each include a circumferential feed duct 70, as described in more detail below. More specifically, each circumferential feed duct 70 is formed integrally with each panel 52. In one embodiment, panels 52 are die-formed stainless steel panels. Panels 52 couple to extend circumferentially around engine 10. More specifically, panels 52 extend around engine 10 and are radially outward from each engine turbine rotor assembly 18 and 20. Accordingly, a first set 72 of panels 52 extend circumferentially around high pressure turbine 20 and a second set 74 of panels 52 extend circumferentially around low pressure turbine 18. In one embodiment, each set 72 and 74 of panels 52 includes eight individual panels 52. Adjacent panels 52 in sets 72 and 74 are coupled together.

During operation, heat generated by operation of engine 10 may cause thermal expansion of the rotor assemblies, and render the tip clearance non-uniform circumferentially. As a result, inadvertent rubbing between the rotor blade tips and engine casing 46 may occur. However, cooling air is bled from one of the stages of high pressure compressor 14 and supplied to clearance control system 40 through transition ducts 62. The cooling air is then supplied to engine casing 46 by clearance control system 40 and distributed circumferentially around engine casing 46.

As a result of the cooling air being introduced into to casing 46, casing 46 thermally contracts, thus maintaining the tip clearance and preventing inadvertent blade tip rubbing against engine casing 46. Clearance control system 40 distributes cooling air circumferentially, thus facilitating efficient heat transfer and radial thermal contraction. Because the cooling air is distributed circumferentially, the clearance control system facilitates substantially uniform heat transfer, such that a substantially uniform tip clearance may be obtained.

Figure 3:
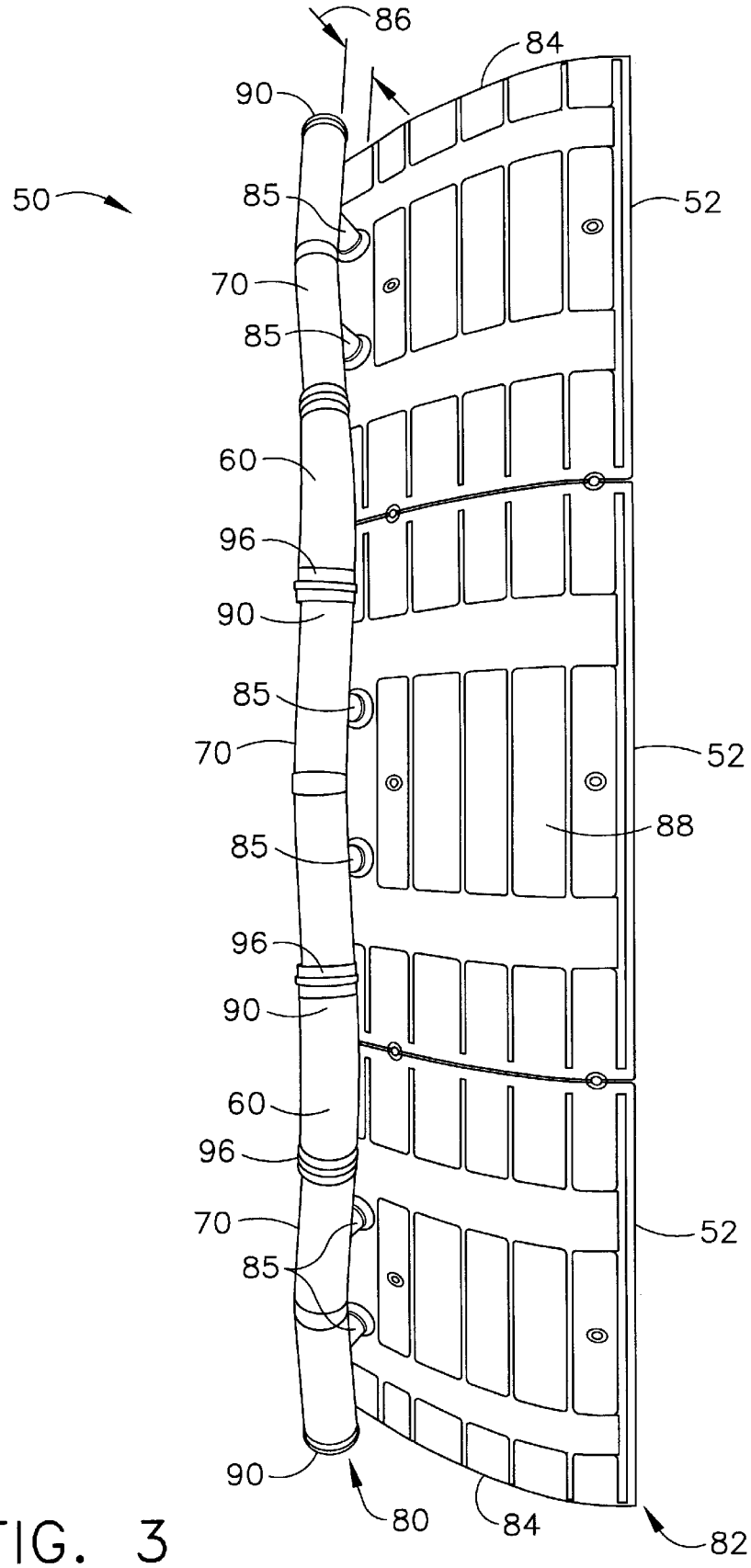
FIG. 3 is an enlarged view of a portion of clearance control system shown in FIG. 2.
Figure 4:
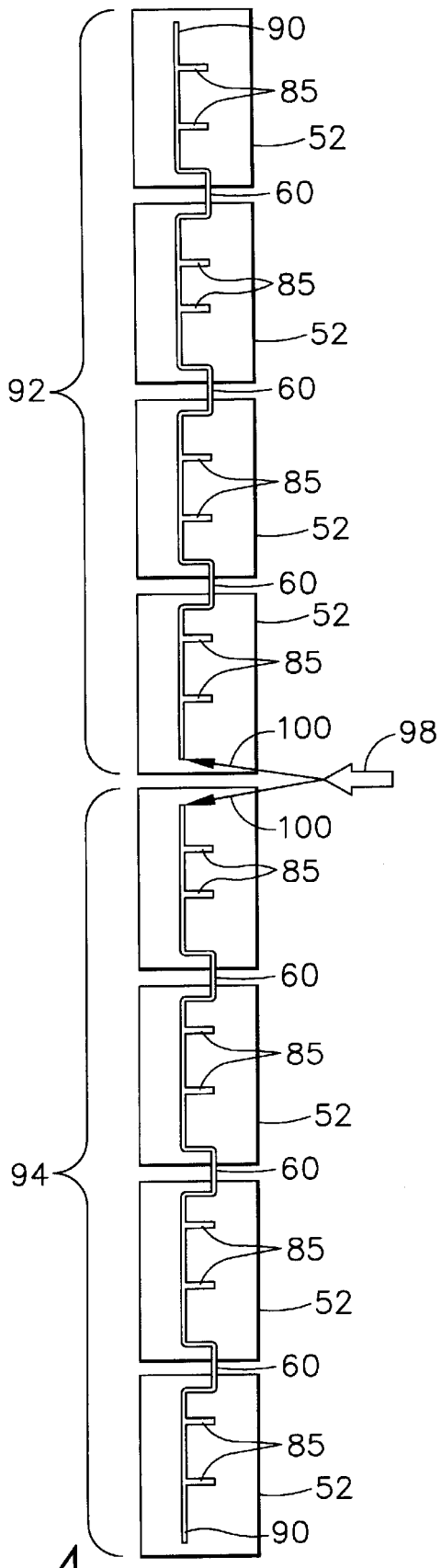
FIG. 4 is a partial schematic illustration of the clearance control system shown in FIG. 3.

FIG. 3 is an enlarged view of a portion of clearance control system 40. More specifically, FIG. 3 is an enlarged view of a portion of second set 74 of panels 52. FIG. 4 is a partial schematic illustration of clearance control system 40. Each clearance control panel 52 includes a leading edge side 80 and a trailing edge side 82 connected with a pair of side edges 84. Adjacent panels 52 are coupled together, such that panels 52 extend circumferentially around engine 10 (shown in FIG. 1). In one embodiment, side edges 84 of each panel 52 are brazed together.

Each circumferential feed duct 70 includes a longitudinal axis (not shown) that extends generally parallel to each panel leading edge side 82. Additionally, each circumferential feed duct 70 includes two inlets 85. Inlets 85 have a length 86, such that circumferential feed duct 70 is distance 86 radially outward from an outer surface 88 of panels 52. Furthermore, each circumferential feed duct 70 also includes an outlet 90.

Connection ducts 60 couple adjacent panels 52 circumferentially around engine 10, such that circumferential feed ducts 70 are connected in flow communication circumferentially around engine 10. More specifically, panels 52 are coupled together such that system 40 is divided into a first side 92 and a second side 94. System first and second sides 92 and 94 are each coupled to an inlet manifold (not shown).

Each connection duct 60 is coupled to each circumferential feed duct 70 and extends between adjacent circumferential feed duct outlets 90, such that each connection duct 60 is connected in flow communication with each circumferential feed duct outlet 90. In the exemplary embodiment, radiator clamps 96 couple each connection duct 60 to each circumferential feed duct 70. Connection ducts 60 are flexible and accommodate axial misalignments between adjacent circumferential feed ducts 70. In one embodiment, connection ducts 60 are fabricated from silicone.

During operation, cooling air 98 is bled from one of the stages of high pressure compressor 14 (shown in FIG. 1) and supplied to clearance control system 40 through transition ducts 62 (shown in FIG. 2). In an alternative embodiment, fan bypass air is supplied to clearance control system 40. More specifically, cooling air 98 is initially supplied to the inlet manifold which splits the airflow between system first and second sides 92 and 94, respectively. Cooling air 98 then enters a first panel 100 of each system side 92 and 94, and is routed through each first panel circumferential feed duct 70 and inlets 85. Cooling air 98 is then supplied to each subsequent adjacent panel 52 through connection ducts 60.

Figure 6:
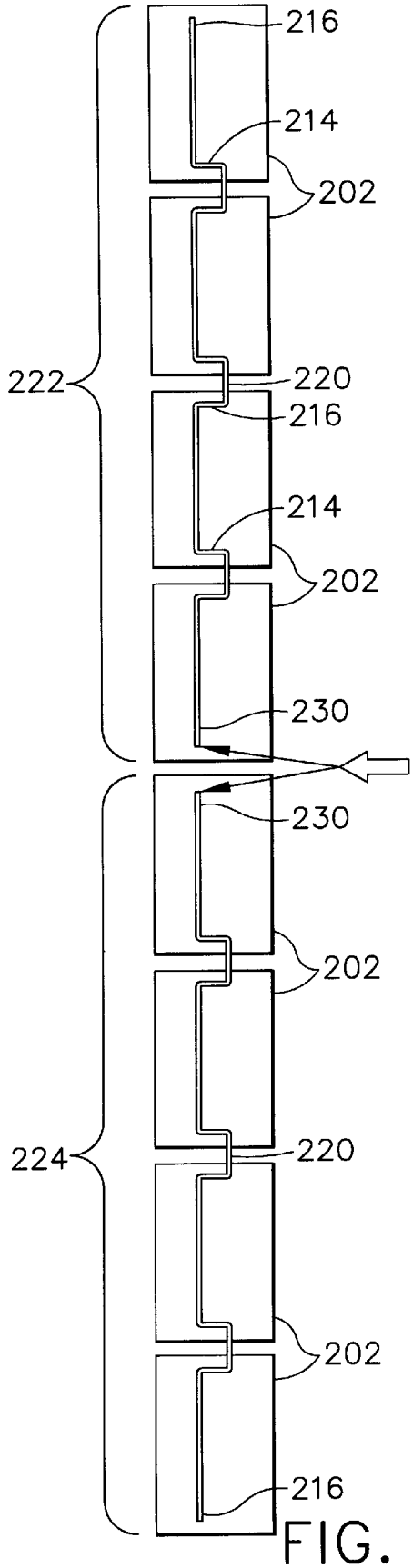
FIG. 6 is a partial schematic illustration of the clearance control system shown in FIG. 5.
Figure 5:
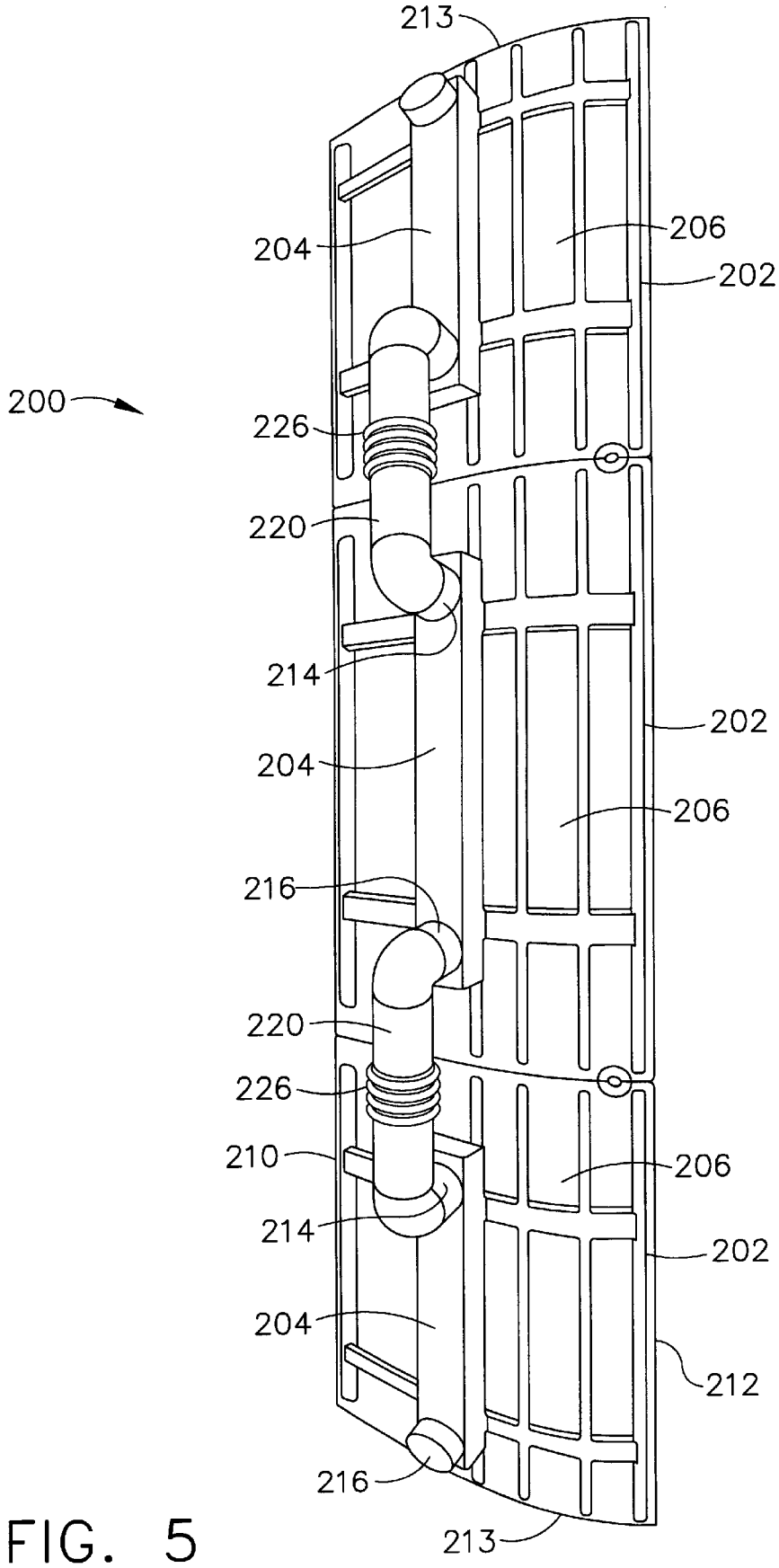
FIG. 5 is an enlarged view of an alternative embodiment of a clearance control system that may be used with the gas turbine engine shown in FIG. 1.

FIG. 5 is an enlarged view of an alternative embodiment of a clearance control system 200 that may be used with gas turbine engine 10 (shown in FIG. 1). FIG. 6 is a partial schematic illustration of clearance control system 200. Clearance control system 200 is substantially similar to clearance control system 40 shown in FIGS. 2, 3, and 4, and components in clearance control system 200 that are identical to components of clearance control system 40 are identified in FIGS. 5 and 6 using the same reference numerals used in FIGS. 2, 3, and 4. Accordingly, clearance control system 200 is known as an Active Clearance Control, ACC, and distributes cooling air to engine 10 to facilitate controlling a tip clearance between rotor blade tips (not shown) and engine casing 46 (shown in FIG. 1).

Control system 40 includes transition ducts 62 (shown in FIG. 2) coupled in flow communication to a plurality of panels 202. Clearance control system panels 202 each include a circumferential feed duct 204. More specifically, each circumferential feed duct 204 is formed integrally with each panel 202, such that each feed duct 204 is adjacent an outer surface 206 of each panel 202. In one embodiment, panels 202 are die-formed stainless steel panels. Each panel 202 includes a leading edge side 210 and a trailing edge side 212 connected with a pair of side edges 213. Adjacent panels 202 are coupled together, such that panels 202 extend circumferentially around engine 10 (shown in FIG. 1). In one embodiment, side edges 213 of each panel 202 are brazed together.

Each circumferential feed duct 204 includes a longitudinal axis (not shown) that extends generally parallel to each panel leading edge side 212. Additionally, each circumferential feed duct 204 includes an inlet 214 and an outlet 216. Between inlet 214 and outlet 216, circumferential feed duct functions as a plenum to supply air radially into engine 10.

A plurality of connection ducts 220 couple adjacent panels 202 circumferentially around engine 10, such that circumferential feed ducts 204 are connected in flow communication circumferentially around engine 10. More specifically, panels 202 are coupled together such that system 200 is divided into a first side 222 and a second side 224. System first and second sides 222 and 224 are each coupled to an inlet manifold (not shown).

Each connection duct 220 is coupled to each circumferential feed duct 204 and extends in flow communication between a circumferential feed duct outlet 216 and an adjacent circumferential feed duct inlet 214. In the exemplary embodiment, radiator clamps 226 couple each connection duct 220 to each circumferential feed duct 204. Connection ducts 220 are flexible and accommodate axial misalignments between adjacent circumferential feed ducts 204. In one embodiment, connection ducts 220 are fabricated from silicone.

During operation, cooling air 98 is bled from one of the stages of high pressure compressor 14 (shown in FIG. 1) and supplied to clearance control system 200 through transition ducts 62. In an alternative embodiment, fan bypass air is supplied to clearance control system 200. More specifically, cooling air 98 is initially supplied to the inlet manifold which splits the airflow between system first and second sides 222 and 224, respectively. Cooling air 98 then enters a first panel 230 of each system side 222 and 224, and is routed through each first panel circumferential feed duct 204 into panels 202 and through feed duct outlet 216. Cooling air 98 is then supplied to each subsequent adjacent panel 202 through connection ducts 220.

The above-described clearance control system is cost-effective and highly reliable. The clearance control system includes a plurality of circumferential feed ducts that are formed integrally with the panels. Adjacent panel circumferential feed ducts are coupled with flexible connection ducts that supply airflow to subsequent panels. During operation, as cooling air is distributed circumferentially between the engine casing and each engine rotor assembly, the clearance control system facilitates maintaining a substantially uniform tip clearance. As a result, the clearance control system facilitates extending a useful life of the rotor assembly in a cost effective and reliable manner.

While the invention has been described in terms of various specific embodiments, those skilled in the art will recognize that the invention can be practiced with modification within the spirit and scope of the claims.

What is claimed is:

1. A method for assembling a clearance control system for a gas turbine engine, the engine including an engine casing and at least one rotor assembly including a plurality of rotor blades, the clearance control system including a plurality of panels, said method comprising the steps of:

providing a plurality of panels including an integral circumferential duct;

coupling at least one panel to an air source; and coupling the plurality of panels together to extend circumferentially around the rotor assembly to permit the clearance control system to distribute cooling air through the engine casing radially inward towards the rotor assembly rotor blades.

2. A method in accordance with claim 1 wherein said step of coupling the plurality of panels together further comprises the step of coupling a connecting duct between adjacent panel circumferential ducts.

3. A method in accordance with claim 2 wherein said step of coupling a connecting duct further comprises the step of coupling a flexible silicone connecting duct to each circumferential duct.

4. A method in accordance with claim 1 wherein said step of providing a plurality of panels further comprises the step of providing a plurality of panels that each include at least one inlet.

5. A method in accordance with claim 4 wherein said step of providing a plurality of panels further comprises the step of providing a plurality of panels that each include at least one outlet.

6. A clearance control system for a gas turbine engine, said clearance control system configured to distribute cooling air circumferentially around the engine, said clearance control system comprising a plurality of panels extending circumferentially around the engine, each said panel including an integral circumferential feed duct, at least two adjacent circumferential feed ducts coupled together by a connecting duct.

7. A clearance control system in accordance with claim 6 wherein said engine comprising at least one row of rotor blades, said clearance control system further comprising a plurality of connecting ducts for coupling adjacent panel circumferential feed ducts.

8. A clearance control system in accordance with claim 7 wherein said connecting ducts comprise flexible silicone ducts.

9. A clearance control system in accordance with claim 7 wherein each said connecting duct clamped to each said circumferential feed duct.

10. A clearance control system in accordance with claim 6 wherein each said panel further comprises at least one inlet.

11. A clearance control system in accordance with claim 10 wherein each said panel further comprises at least one outlet.

12. A clearance control system in accordance with claim 6 wherein said plurality of panels comprises eight panels.

13. A gas turbine engine including a rotor assembly including a plurality of rotor blades, said gas turbine engine comprising an engine casing extending circumferentially around the rotor assembly, and a clearance control system configured to distribute cooling air circumferentially around the engine through said engine casing, said clearance control system comprising a plurality of panels extending circumferentially around the engine, each said panel including an integral circumferential feed duct, at least two adjacent circumferential feed ducts coupled together by a connecting duct.

14. A gas turbine engine in accordance with claim 13 wherein said clearance control system further configured to supply cooling air through said engine casing radially inward towards the rotor assembly rotor blades.

15. A gas turbine engine in accordance with claim 14 wherein said clearance control system further comprising a plurality of connecting ducts for coupling adjacent panel circumferential feed ducts.

16. A gas turbine engine in accordance with claim 15 wherein said clearance control system further comprises a plurality of clamps configured to couple each said connecting duct to said circumferential feed ducts.

17. A gas turbine engine in accordance with claim 15 wherein said clearance control system connecting ducts comprise flexible silicone ducts.

18. A gas turbine engine in accordance with claim 15 wherein each said panel comprises at least one inlet.

19. A gas turbine engine in accordance with claim 15 wherein each said panel further comprises at least one outlet.

20. A gas turbine engine in accordance with claim 15 wherein said clearance control system plurality of panels comprise eight panels, said clearance control system further configured to supply cooling air between said engine casing and the rotor blades.

* * * * *